United States Patent [19]

Wright

[11] 4,162,738

[45] Jul. 31, 1979

[54] STACKING PLASTIC BOTTLE CASE

[75] Inventor: William V. Wright, Charlotte, N.C.

[73] Assignee: Metrolina Design Group, Charlotte, N.C.

[21] Appl. No.: 806,688

[22] Filed: Jun. 15, 1977

[51] Int. Cl.[2] ..... B65D 1/24; B65D 21/02

[52] U.S. Cl. ..... 220/21; 206/503

[58] Field of Search ..... 220/21; 206/427, 503

[56] References Cited

U.S. PATENT DOCUMENTS

| | | | |
|---|---|---|---|
| 2,535,493 | 12/1950 | Gerber | 220/21 |
| 2,970,715 | 2/1961 | Kappel | 220/21 |
| 3,106,308 | 10/1963 | Kazimer | 220/21 |
| 3,333,727 | 8/1967 | Belcher | 220/21 |
| 3,341,054 | 9/1967 | Hirota | 220/21 |
| 3,349,943 | 10/1967 | Box | 220/21 |
| 3,391,815 | 7/1968 | Box | 220/21 |
| 3,392,869 | 7/1968 | Needt | 220/21 |
| 3,701,449 | 10/1972 | Schoeller | 220/21 |

*Primary Examiner*—George E. Lowrance

*Attorney, Agent, or Firm*—Richards, Shefte & Pinckney

[57] ABSTRACT

A molded plastic case has multiple pockets for bottles and recesses formed in its undersurface in register with the pockets for engagement with the tops of bottles in the pockets of like cases located thereunder for stacking. Partition walls within the case intersect each other and the outside walls to form the pockets, and the partition walls are cut away suitably for hand clearance adjacent the handholes in the end walls of the case. The recesses take a rimmed form defined by openings in the case undersurface leaving only ribs extending from the walls of each pocket to support its respective rimmed recess. The recesses are defined in lateral extent by walls of greater height than the edge radius of the bottles and bottle caps used therewith, and the recesses slope from those walls to flat midportions, which are the deepest parts of the recesses and are formed so that a bottle cap may be centered thereat by the sloping recess bottom without defacement of the flat cap top thereby. The lateral extents of the recesses accommodate extreme positions of the caps of bottles in like cases stacked therebelow for centering and retaining action therewith to form a stable stack. The edges of the case undersurface are relieved for telescoping engagement inside the top edges of the outside walls of other like cases for stacking empty cases.

12 Claims, 10 Drawing Figures

FIG.5
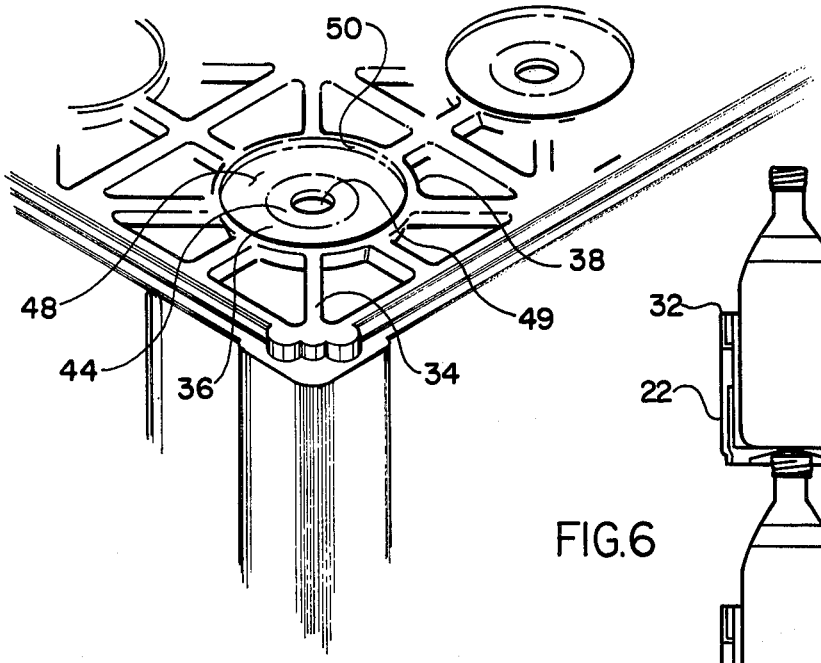
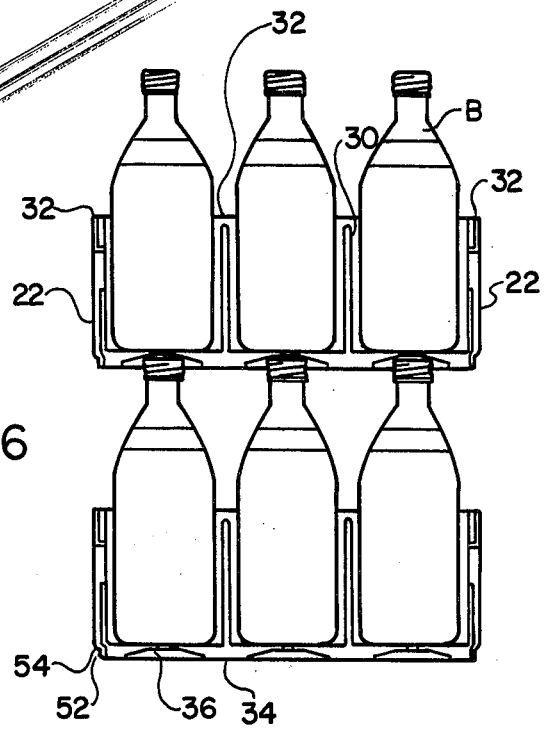
FIG.6
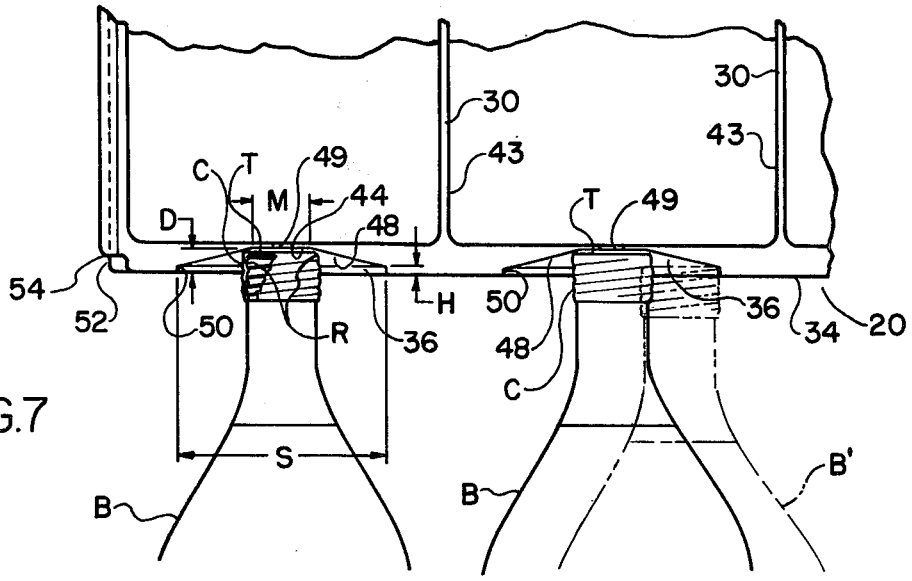
FIG.7

STACKING PLASTIC BOTTLE CASE

BACKGROUND OF THE INVENTION

Bottle cases or crates with pockets for locating and separating bottles have been in wide use, and have had essentially flat bottoms for stacking on the tops of bottles in like cases for storage. Such cases of wood, metal, and/or plastic construction wherein the cases are of considerably less height than the bottles are disclosed in U.S. Pat. Nos. 2,293,893, 2,667,284, and 3,107,026. Such cases were reasonably satisfactory for many years, but demands for safety, waste reduction, and better utilization of floor space for storage have combined with the availability of fork lift trucks and palletized storage methods to point up the problems with these cases, mainly their tendency to slide around on each other when stacked up, whether containing full or empty bottles, or even when stacked empty of bottles. Stacking loaded cases five or six layers high on pallets, and then perhaps stacking loaded pallets atop one another for fork lift truck transport and storage, is full of danger from cases knocked off the stacks by passing personnel, vehicles, or palletized loads; not to speak of the disadvantages of the necessity for building perfect stacks and handling them very gently so that cases do not slide off or out of the stacks during palletized transport and storage with the ensuing tilting and joggling of the stacks, though interlocked but without positive engagement.

In order to form more stable columnar stacks using such cases, intermediate supports as disclosed in U.S. Pat. No. 1,747,408 have been provided to act as fillers in the vertical spaces between stacked cases. These supports fit telescopically with both upper and lower cases for stability, and also prevent the upper cases from resting on the tops of bottles in the lower cases, but they are not attractive because of the extra initial cost, handling, and storage involved, as well as the accurate registry required during stacking, and no simultaneous interlocking.

Other cases or crates have had side walls higher than the bottles, so that the cases stack upon themselves rather than upon the bottles underneath, and likewise have only flat bottoms with no provision for stabilizing a stack; such a case is shown in U.S. Pat. No. 2,830,729.

Other bottle cases, such as those disclosed in U.S. Pat. Nos. 2,758,742 and 3,380,616, have had side walls higher than the bottles, and their tops and bottoms have been formed for telescopic engagement when stacked, so that they would form reasonably stable columnar stacks, but with no provision for interlocking stacks for maximum stability. Cases of this type require correspondingly more material for manufacture, and are heavier and bulkier for shipment without bottles than lower cases, and are heavier for handling both empty and full, as well as bulkier for empty storage. Stacking of such cases requires accurate placement to achieve proper telescopic engagement, and of course this is difficult in the rough handling environment of the usual bottle distribution and re-use system.

Thus, while the bottle cases of the first and third paragraphs of this Background were incapable of forming positively locked-together, stable stacks, and those of the second and fourth paragraphs telescope in columns only without provision for simultaneous interlocking stacking, through separate filler pieces or comparatively larger and heavier cases all requiring accurate placement of the cases, the cases of the present invention allow positively interlocked stacking of filled cases in a variety of completely stable stack configurations without requiring excessively accurate placement of the cases on the stacks, the empty cases also telescope, and the bulk and weight of the empty cases is kept to a minimum. The present invention includes all the advantages of the prior art, omits the disadvantages of the prior art, and introduces advantages of its own such as self-centering action in a stack.

Bottle cases according to the present invention overcome these problems with a minimal weight and usage of material and provide positive lateral engagement directly with the bottles of other cases when stacked one upon another, and thereby form very stable stacks with no possibility of one case sliding from atop the bottles of another case. These cases also allow positively interlocked stacking in "pinwheel" or other stack forms with the same positive lateral engagement for extra stable stacking similar to interlocking brickwork. These cases do not require accurate positioning of one case on another when filled with bottles—if reasonably well located over the bottles underneath (just well enough to engage bottle tops and case recesses), any shaking or joggling of the upper cases causes them to act in self-centering fashion on the bottles beneath, and the stack assumes a more regular form whether stacked in columnar or interlocking fashion. Cases according to the present invention are light and small for ease of handling and shipping, have provision made in tops and bottoms for telescopic columnar stacking when empty, and occupy correspondingly less volume when so stacked then the previous telescoping full bottle height cases.

SUMMARY OF THE INVENTION

The bottle case of the present invention has multiple pockets for bottles formed in the upper portions thereof and has recesses formed in the portions of the undersurface of the case beneath the pockets and in register with them for laterally retaining engagement with the tops of bottles resting in the pockets of like cases located thereunder for stacking.

Briefly described, the pockets of the case are formed by its outside walls and by intersecting partition walls within the outside walls, and the undersurface of the case has openings formed about each of the recessed portions to give each recessed portion a rim supported by ribs extending thereto from the surrounding pocket walls, whereby the case is lightened and further discontinuities are provided in the undersurface for traction with conveyor belts. The outside walls at the ends of the case have handhold openings disposed intermediately of their height, and since the partition walls are of only slightly lower height, the partitions are cut away adjacent the openings to provide clearance for hands inserted therein.

Preferably the cases of this invention have recesses whose bottoms each slope gently from the periphery of the recess toward the deepest part thereof at its midportion so that the recess will engage the top of a bottle on which it is stacked with a centering action. These converging bottom slopes are carried far enough toward the midportion so that the flat top of a suitably sized bottle cap of a bottle in centering engagement with the slopes is held by the slopes from engagement with the suitably formed remaining midportion of the recess which might deface any printed legend on the bottle cap. The lateral extent of the recess is defined by walls of greater height than the edge radii of the bottle tops and bottle caps used, so that there will be positive lateral engagement of bottle and recess when the case is displaced far enough in a lateral direction from a bottle.

In the preferred embodiment of this invention, the lateral size of each recess is large enough so that the defining walls of adjacent recesses will encompass the caps of bottles at both the maximum and minimum spacings of bottles resting normally within corresponding adjacent pockets of like cases disposed beneath a case, even when two adjacent bottles may be in separate cases which are disposed in their normally suitable adjacent lateral dispositions for interlocking stacking. Typical recesses may have a round or circular shape of about 83 millimeters diameter, a defining wall height of about 2.5 millimeters, and a maximum depth of about 7.5 millimeters. In preferred form, the undersurface of the case has a relieved portion adjacent its periphery forming a shouldered ledge which allows the remainder of the undersurface to fit telescopically within, and the ledge to rest upon, the top edges of the side walls of an empty like case located thereunder for forming a stable stack of empty cases.

BRIEF DESCRIPTION OF THE DRAWINGS

FIG. 5 is an enlarged partial perspective view of one corner of the case as seen from below;

FIG. 6 is a vertical section of two stacked cases containing bottles;

FIG. 7 is an enlarged portion of FIG. 6;

DESCRIPTION OF THE PREFERRED EMBODIMENT

Figure 1:
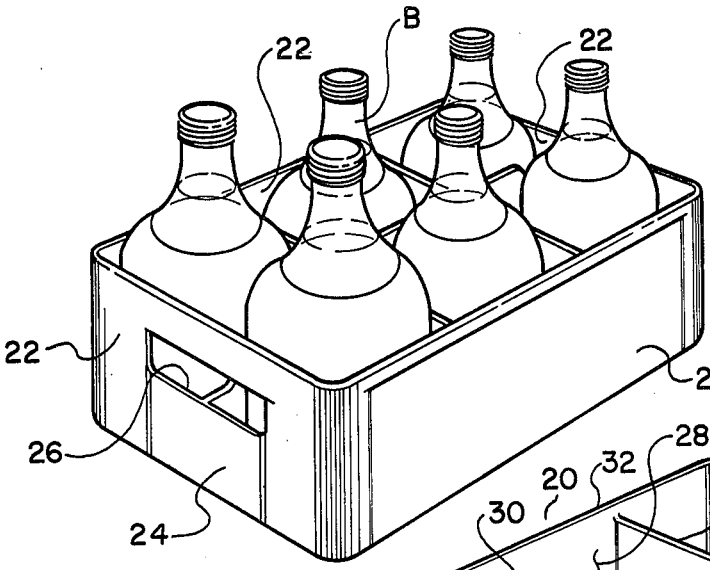
FIG. 1 is a perspective view of a bottle case of the present invention containing bottles in its pockets.
Figure 2:
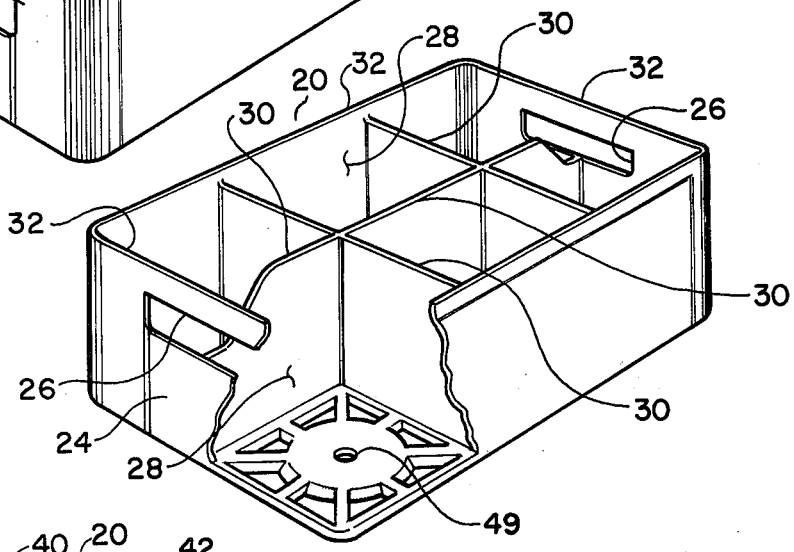
FIG. 2 is a similar view of an empty case partially broken away to show the bottom of a pocket.
Figure 3:
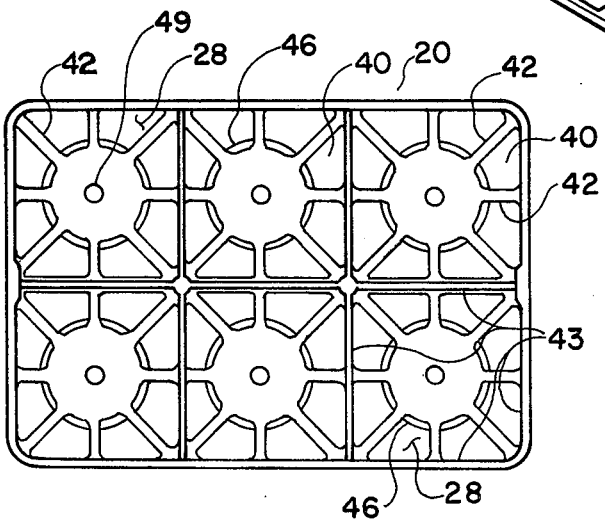
FIG. 3 is a plan view of the case of FIG. 2.
Figure 8:
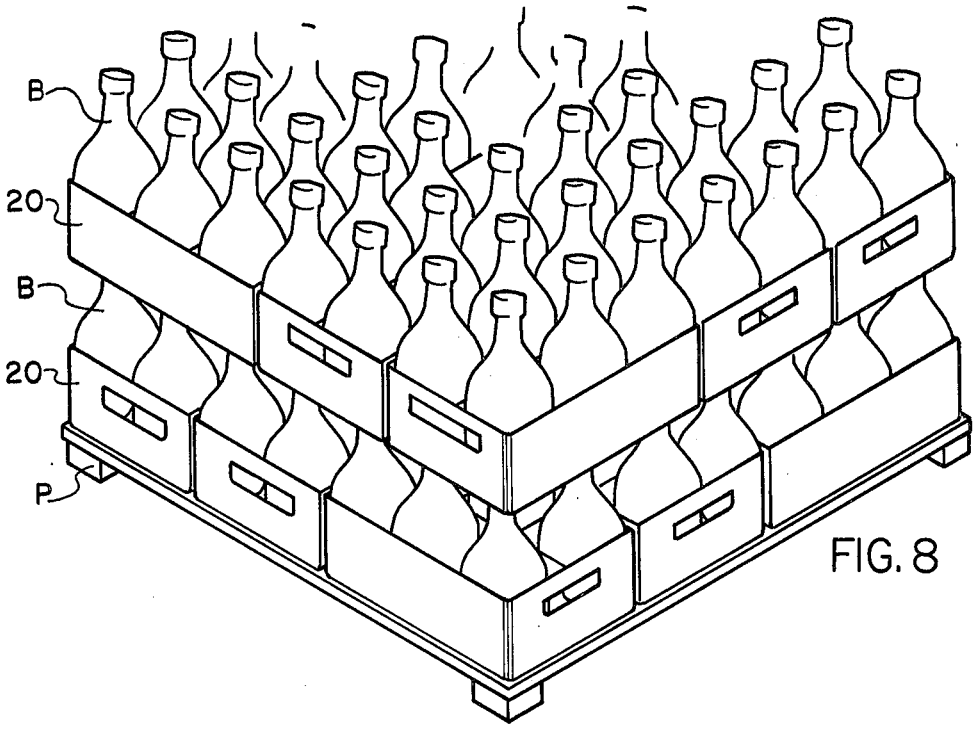
FIG. 8 is a perspective view of a "pinwheel" stack of cases.

The chief object of this invention is to facilitate the stacking of the cases of bottles into highly stable stacks for storage or transport. A typical interlocking, "pinwheel" type of stack is shown at FIG. 8. As shown in FIG. 1, a case filled with bottles is of generally typical form in that its outside walls are considerably lower than the bottles, in that it has criss-crossed intersecting partition walls inside the case to form pockets for separating and locating the bottles, and as shown in FIG. 2 the bottom of the case has openings to allow easy drainage of spillage or of cleaning solutions.

Specifically, the preferred embodiment of this invention is an oblong rectangular case 20 having outside walls 22 of height considerably less than the height of a bottle B, and the end walls 24 of the case 20 have handholds 26 formed therein intermediately of the height thereof for manual lifting thereof. The case 20 is typically divided into six pockets or compartments 28 by partition walls 30 therein; and for different sizes and shapes of bottles B, other numbers of pockets 28 such as twelve, twenty-four, or otherwise, may be provided. For purposes to be explained later, these partition walls 30 are slightly lower than the outside walls 22, and stop several millimeters below the top edges 32 of the outside walls 22. The partition walls 30 are cut away adjacent the handholds 26 to provide clearance for grasping the handholds 26.

Figure 4:
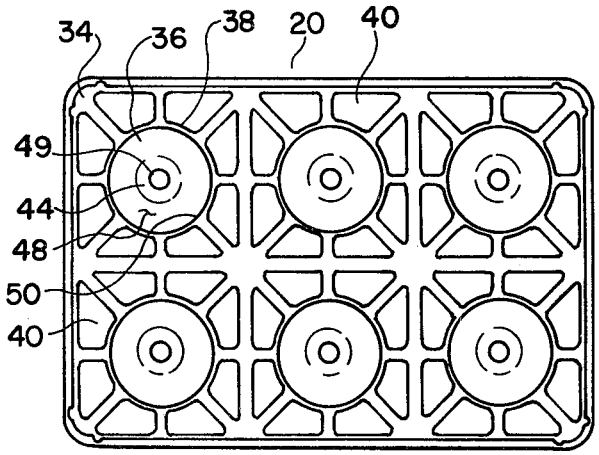
FIG. 4 is a bottom view of the case of FIG. 2.

As seen in FIGS. 4, 5 and 7, in this preferred embodiment, the case 20 is injection molded from a plastic, such as polyethylene, and the undersurface 34 of the case 20 is indented by recesses 36, one located in the portion of the undersurface 34 beneath each pocket 28 in registration therewith, each recess 36 being bounded and defined by a rim 38 which remains after the various openings 40 have been formed in the undersurface 34 in shapes to leave ribs 42 extending from the surrounding walls 43 of the pockets 28 toward the midportions 44 of the recesses 36 to support the recessed portions 46. These openings 40 serve to lighten the case 20, to provide further discontinuities in the undersurface 34 for traction with conveyor belts, to save plastic material, and to provide for drainage of spillage from bottles or of cleaning solutions used in the cases. While these recesses are illustrated in this embodiment as being circular in lateral shape, they may take any other suitable shape such as polygonal, oval, or irregular, or only partially enclosed.

Each recess 36 has a bottom 48 which slopes inwardly from all points at the periphery thereof to the midportion 44 thereof such that a recess 36 set on top of a bottle 31 off center as shown in broken lines in FIG. 7, while stacking a case 20 on the tops of bottles resting in the pockets 28 of a like case 20 located thereunder for stacking, will have a self-centering action to move the top of the bottle B and the recess 36 into centered relation as shown in solid lines in FIG. 7. The broad frustoconical shape of the recess bottom 48 as shown in FIG. 7 is preferred, but other shapes might be equally useful so long as they effectively slope toward the midportion 44 which is the deepest part of the recess. The midportion 44 may be flat as shown in FIG. 7, conical, omitted (a larger hole 49 than that shown in FIG. 7 for drainage may be used), or other shape, but regardless of the shape of the midportion 44, the sloping bottom 48 should engage bottle top cap C, whether centered or not, so that the flat top T of a suitably sized cap C will not engage the midportion 44 for defacement or disfiguration thereby of any printing or decoration on the flat top T of the cap C. The upstanding sidewalls 50 which define the lateral extent of the recesses 36 at the rims 38 thereof are preferred to be of a height H greater than the chamfer or radius R at the engaging edge or corner of the top of a bottle B or of a bottle cap C so that a case 20 may be shifted around on top of the bottles B, either empty or filled and capped, on which it is stacked without danger of slipping off, since the sidewalls 50 of the recesses 36 will positively retain the tops of the bottles B therein.

While very stable columnar stacks of cased bottles may be formed with the cases 20 directly over each other as shown in FIG. 6, cases 20 are frequently stacked on large pallets P as shown in FIG. 8 for transportation by forklift truck, and a convenient stack of considerable height may be formed in "pinwheel" fashion as shown in FIG. 8. However, it is obvious that such a stack, perhaps five or six layers high, or more, could be very unstable and dangerous during forklift truck handling if formed from cases constructed according to the prior art as explained in the Background above. A forklift truck, or even a person, brushing against a high stack in passing could easily dislodge one or more cases with great danger to personnel, not to speak of the economic loss in frequent mishaps of this kind. It will also be obvious that with the bottle B and case recess 36 engagement as shown in FIG. 7, such an accident could hardly occur. In fact, the vibrating, shaking, and jostling of handling and transport with a forklift truck only causes the self-centering effect of the recesses 36 to cause the cases 20 to form themselves into more regular and better registered stacks.

Figure 9:
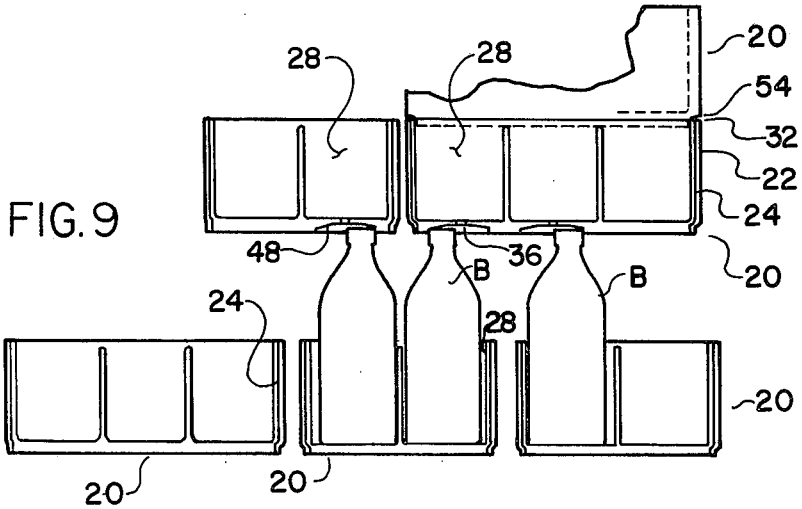
FIG. 9 is a partial vertical sectional view of the stack of FIG. 8 with an extra empty case atop an empty case in the top layer of the stack.

A special problem with stacks such as those of "pinwheel," or other interlocking, form is that of double wall thicknesses between adjacent cases 20, especially at the end walls 24 of the cases 20 where the wall thickness is somewhat greater than at the sides, as shown in FIG. 9. In these circumstances there will not be perfect registration between the pockets 28 in successive layers of stacked cases 20, but this is readily accommodated by the center action of the sloping bottoms 48 of the recesses 36 and the extra space within the pockets 28 in which bottles B may shift around. Thus, there is an overall centering and aligning effect amongst the pockets 28, the bottles B, and the recesses 36 between layers of cases 20 and amongst the various cases 20 in each layer, so that the aforementioned centering and regularizing effect on the stack is still highly effective.

Figure 10:
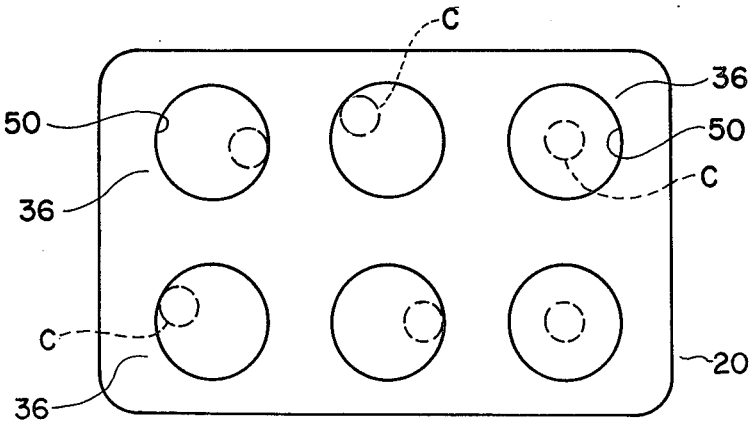
FIG. 10 is a bottom view of a case showing possible bottle cap positions thereunder.

In order to accommodate the above-mentioned lack of registration of corresponding pockets 28 and recesses 36 in successive layers of the cases 20, the lateral size of the recesses 36 is large enough to accommodate the normal maximum and minimum spacings of the bottles B in a lowermost layer and the recesses 36 in an uppermost layer of the cases 20, including allowances for case manufacturing tolerances, spaces between the cases 20, and the bottles B shifting within the pockets 28. FIG. 10 shows diagrammatically bottle caps C at various spacings falling within sidewalls 50 of recesses 36. Typically preferred dimensions for the recesses of this invention to accommodate all of the above-mentioned allowances are as follows: Diameter S of the recess 36—about 83 millimeters; height H of the recess sidewall 50—about 2.5 millimeters; depth D of the recess 20—about 7.5 millimeters; and maximum diameter M of the recess midportion 44—approximately 32 millimeters to protect a bottle cap C of 38 millimeter diameter. Such recesses will accommodate variations of about 22 mm from theoretically perfect center-to-center dimensions of both bottles B and recesses 36 simultaneously.

Since empty cases 20 must also be stacked, transported, and stored, it is highly desirable that they be stacked stably empty also, and it is for that reason that the inner partition walls 30 are several millimeters lower than the top edges 32 of the sidewalls 22 of the case 20 as heretofore described. A relief 52 is provided around the peripheral edges of the undersurface 34 of the case 20 so that the undersurface 34 may thereby telescope inside and beneath the top edges 32 of the outside walls 22 of another like case 20, and the relief 52 provides a shouldered ledge 54 to rest upon the top edges 32 of the outside walls 22 of a case 20 as shown in FIG. 9.

Thus, the bottle case of the present invention provides a simple, light, compact case of very great stacking stability when filled with bottles, it is easy to stack, handle, and keep clean; and it is inherently adapted to automatically convert to stable stacking of empty cases when the bottles are removed.

The particular embodiment disclosed in full detail herein and illustrated in the drawings has been provided for disclosure purposes only and is not intended to limit the scope of the present invention, which is to be determined by the scope of the appended claims. In this regard it should be noted that the present invention is intended to encompass bottles of various construction, material and configurations and similar containers for like use.

I claim:

1. A case for bottles having multiple pockets for bottles formed therein and recesses formed in the portions of the undersurface of the case beneath the pockets for case stacking engagement with the tops of bottles in cases located thereunder, said recesses having upstanding side walls and midportions at which said recesses are deepest, said recesses having bottoms located within and connected to said walls and sloping toward said midportions effectively throughout the extent of said recesses between said walls and said midportions for centering action of said bottoms with said tops of bottles wherever said tops engage said bottoms, said walls having a height sufficient to prevent said recesses from being shifted sidewise out of said engagement with said tops and said recesses having lateral extents substantially larger than the lateral extents of said tops.

2. A case for bottles according to claim 1 and characterized further in that said tops of bottles have caps with flat tops thereon and in that said midportions have diameters less than those of the flat tops of the caps of said bottles.

3. A case for bottles according to claim 1 and characterized further in that said tops of bottles have caps with flat tops thereon and in that each said midportion is of suitable form so that the flat top of a bottle cap of a bottle in said centering engagement with said recess is held from defacing engagement with said midportion by said sloping bottom.

4. A case for bottles according to claim 1 and characterized further in that said recess walls are of greater height than the edge radii of bottle tops and bottle caps used therewith.

5. A case for bottles according to claim 4 and characterized further in that said recesses have a round shape of about 83 mm diameter, a defining wall height of about 2.5 mm, and a depth of about 7.5 mm.

6. A case for bottles according to claim 1 and characterized further in that (a) said tops of bottles selectively have caps with flat tops thereon and each said midportion is of suitable form so that the flat top of a bottle cap of a bottle in said centering engagement with said recess is held from defacing engagement with said midportion by said sloping bottom;

(b) said pockets are formed by the outside walls of said case and by intersecting partition walls within said outside walls;

(c) the undersurface of the case has openings formed therein about each of said recessed portions such that each recessed portion has a rim and is supported by ribs extending thereto from the walls of the pocket surrounding said recessed portion;

(d) said partition walls are slightly lower than said outside walls;

(e) said outside walls at the ends of said case have handhold openings disposed therein intermediately of the height thereof; and (f) said partition walls are cut away suitably for clearance for hands inserted in said handhold openings.

7. A case for bottles according to claim 6 and characterized further in that (a) said recesses are in register with said pockets for said engagement and in that said bottles are resting in the pockets of like cases;

(b) said recess walls are of greater height than the edge radii of bottle tops and bottle caps used therewith;

(c) said recesses have a round shape of about 83 mm diameter, a defining wall height of about 2.5 mm, and a depth of about 7.5 mm;

(d) said undersurface has a relieved portion adjacent its periphery forming a shouldered ledge to allow said undersurface to fit telescopically within, and the ledge to rest upon, the top edges of the side walls of a like case empty of bottles and located thereunder for stacking.

8. A case for bottles according to claim 1 and characterized further in that said pockets are formed by the outside walls of said case and by intersecting partition walls within said outside walls.

9. A case for bottles according to claim 8 and characterized further in that the undersurface of the case has openings formed therein about each of said recessed portions such that each recessed portion has a rim and is supported by ribs extending thereto from the walls of the pocket surrounding said recessed portion.

10. A case for bottles according to claim 8 and characterized further in that said partition walls are slightly lower than said outside walls, said outside walls at the ends of said case have handhold openings disposed therein intermediately of the height thereof, and said partition walls are cut away suitably for clearance for hands inserted in said handhold openings.

11. A bottle case according to claim 1 and characterized further in that said undersurface has a relieved portion adjacent its periphery forming a shouldered ledge to allow said undersurface to fit telescopically within, and the ledge to rest upon, the top edges of the side walls of a like case empty of bottles and located thereunder for stacking.

12. A case for bottles according to claim 1 and characterized further in that said recesses are in register with said pockets for said engagement and in that said bottles are resting in the pockets of like cases.

* * * * *